United States Patent [19]

Paradis

[11] Patent Number: 4,559,676

[45] Date of Patent: Dec. 24, 1985

[54] FILAMENT FASTENER WITH LOCKING HEAD

[75] Inventor: Joseph R. Paradis, Holden, Mass.

[73] Assignee: Dennison Manufacturing Company, Framingham, Mass.

[21] Appl. No.: 325,073

[22] Filed: Nov. 25, 1981

[51] Int. Cl.[4] ..... B65D 63/10

[52] U.S. Cl. ..... 24/16 PB; 24/17 AP; 292/318

[58] Field of Search ..... 24/16 PB, 17 AP, 30.5 P, 24/150 FP; 292/318, 319, 321

[56] References Cited

U.S. PATENT DOCUMENTS

| | | | |
|---|---|---|---|
| 3,367,701 | 2/1968 | Wenk, Jr. | 292/321 |
| 3,402,435 | 9/1968 | Merser | 24/16 PB |
| 3,600,027 | 8/1971 | Noland | 24/16 PB |
| 3,718,355 | 2/1973 | Canter | 24/16 PB |
| 3,816,879 | 6/1974 | Merser et al. | 24/16 PB |
| 3,881,759 | 5/1975 | Fuehrer | 292/321 |
| 3,924,298 | 12/1975 | Merser | 24/16 PB |
| 4,059,300 | 11/1977 | Moberg et al. | 24/16 PB |
| 4,240,183 | 12/1980 | Sumimoto et al. | 24/16 PB |
| 4,245,374 | 1/1981 | Suzuki | 24/17 AP |

FOREIGN PATENT DOCUMENTS

| | | | |
|---|---|---|---|
| 2901061 | 8/1979 | Fed. Rep. of Germany | 24/16 PB |
| 1075876 | 10/1954 | France | 24/30.5 P |

*Primary Examiner*—Paul J. Hirsch

*Attorney, Agent, or Firm*—George E. Kersey; Barry D. Josephs; Gary S. Winer

[57] ABSTRACT

A fastener formed by an elongated member with an apertured tip, such as a filamentary string, that is attached to a bi-directional locking head with longitudinally opposed openings. The elongated member is inserted into either of the opposed openings of the head, where it is engaged and locked in place by an internal, at least partially circumferential ring. Once the apertured tip is inserted into the locking head it remains in its locking position even if the filamentary string becomes separated from it as a result, for example, of pilferage.

15 Claims, 7 Drawing Figures

FILAMENT FASTENER WITH LOCKING HEAD

BACKGROUND OF THE INVENTION

This invention relates to the fastening of objects, either together or one to another, and more particularly, to the secure, simplified fastening of objects.

Devices which are used to fasten objects typically make use of a strap connected to a locking head. The free end of the strap is threaded through or around the objects to be fastened and then inserted into the head.

In order to achieve secure fastening and prevent unauthorized tampering, the locking head generally is in the form of an enclosure that houses a locking tang and prevents unauthorized access to it. Such a housing is typically mechanically complex, and the strap must be inserted in a particular way. This detracts from the efficiency of the fastener. It is necessary to provide instructions for use of the fastener, and the user needs to be certain that the strap is properly inserted into the locking head.

Furthermore, the inserted end of the strap often tends to have a relatively massive configuration in order to achieve the desired locking effect. This makes the usual protected locking head fastener undesirable in use, for example, with control tags for items of merchandise. The massivity of the strap might damage the merchandise or leave an unsightly hole.

Another difficulty encountered with protected head fasteners is that the locking tang is a relatively weak member that can become separated from its position of connection to the head.

Accordingly, it is an object of the invention to achieve the secure fastening of objects without the need for special instructions in the use of the fastener. A related object is to facilitate the proper insertion of the free end of a strap into its locking head. Another related object is to achieve a locking head fastener that is able to accommodate the free end of its strap in a number of different ways. Another related object is to achieve a locking head fastener in which the strap can be used bidirectionally.

A further object of the invention is to achieve a fastener in which the strap that is inserted into a locking head does not require massive proportions to achieve the desired locking effect.

It is still another object of the invention to achieve a fastener with a durable locking mechanism that is easy to use and not likely to be damaged.

Still another object of the invention is to avoid the need for movable fingers, either in the socket of the fastener or on the head that is inserted into the socket.

A further object of the invention is to provide a security fastener which cannot be reused in the event of pilferage. A related object is to produce blockage of the socket to prevent reuse of the fastener in the event of pilferage.

SUMMARY OF THE INVENTION

In accomplishing the foregoing and related objects, the invention provides a fastener in which a filamentary strip or a strap is attached to an apertured housing that serves as a locking head and is provided with an apertured tip that is lockably inserted into the head.

In accordance with one aspect of the invention, the housing is open at opposed ends, and the locking mechanism is formed by an internal circumferential ring that can be partially open. The locking ring is able to receive, in either direction of insertion, the apertured free end of the elongated member.

In accordance with another aspect of the invention, fixed locking vanes are positioned oppositely positioned on the apertured tip of the elongated member.

In accordance with another aspect of the invention, the aperture in the tip is in the form of a double wedge, each with diverging sides that meet at a central position so that the maximum opening of the aperture is at an intermediate location along the length of the tip. The fixed locking vanes or ramps on the tip desirably terminate at the position of maximum opening of the aperture and include surfaces that diverge from the tip end to surfaces that are able to engage the internal locking ring of the housing. This engagement causes the ramps to be compressed towards one another and permit the tip to enter into the housing beyond the locking ring, after which the ramps expand and lock the tip securely into position within the housing.

In accordance with a still further aspect of the invention, the ramp effect facilitates the proper insertion of the free end of the elongated member into the apertured housing.

In accordance with yet another aspect of the invention the apertured tip, when locked in the housing, produces an irremovable blockage of the entry into the housing, so that if the filamentary strip or strap is pulled from the tip, the fastener cannot be reused. This provides security and prevents reuse of the fastener in the event of pilferage or in case of an unauthorized attempt to remove the tip from its locked position in order to reattach the fastener in an unauthorized fashion.

BRIEF DESCRIPTION OF THE DRAWINGS

Other aspects of the invention will become apparent after considering several illustrative embodiments taken in conjunction with the drawings in which.

DETAILED DESCRIPTION

Figure 1A:
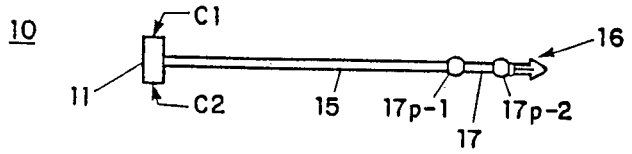
FIG. 1A is a perspective view of an extended fastener in accordance with the invention, before stretching of its connecting filament.

With reference to the drawings, FIG. 1 shows a fastener in accordance with the invention before elongation of its central filamentary portion 15. The fastener 10 additionally includes an apertured housing 11 in the form of a cylindrical locking head with longitudinally opposed circular openings $C_1$ and $C_2$. The elongated member 15 is centrally attached to the housing 11 and has a free end or apertured tongue 16 that is inserted into one of the circular openings $C_1$ and $C_2$, to become irremovably locked in the housing 11.

The fastener 10 is customarily produced by molding of a stretch reorientable plastic material, such as polypropylene, nylon and the like. After molding has been completed the fastener is in the form shown in FIG. 1A with a thickened filamentary portion 15, and a connecting portion 17. After the fastener 10 is removed from its mold, the filamentary portion 15 is elongated by stretching, for example by gripping the locking head or housing 11 in a jaw (not shown) and simultaneously gripping the end of the filament 15 by a protuberance 17*p*-1 and drawing the jaws apart.

Figure 1B:
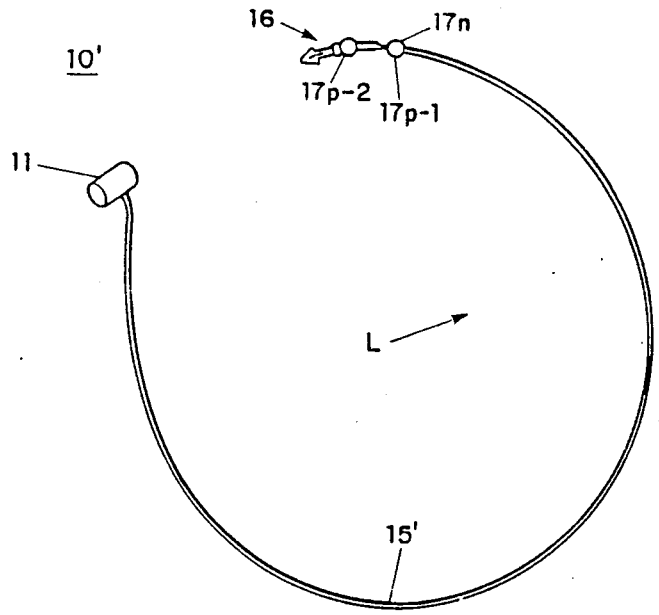
FIG. 1B is a perspective view of the fastener of FIG. 1A after stretching of its filament showing the tip end in position for being inserted into the head.

The result of the stretching operation produces the modified fastener 10' of FIG. 1B in which the central filamentary portion 15 of FIG. 1A has become extended into an elongated and comparatively thinner filament 15' that extends between the housing or head 11 and the tip 16 by way of the connection portions 17. In addition, the connecting portion includes a neck 17*n* of reduced cross section which provides a breakage point in case of an unauthorized tampering with the device 10'.

In particular FIG. 1B shows the elongated filament 15' positioned in the form of a loop L with the tip 16 in position for being inserted into the locking head 11. The locking ring 11*r* can be provided with openings 11*o* in order to permit some compression and facilitate entry of the tip 16 into the housing 11.

Figure 2A:
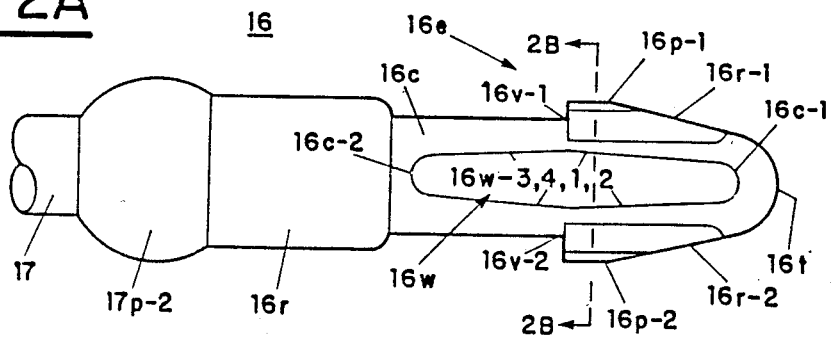
FIG. 2A is an enlarged plan view of the tip portion of the fastener of FIGS. 1A and 1B.

Details of the apertured tip 16 which bring about the desired locking engagement in the housing 11 are illustrated in FIG. 2A.

Figure 2B:
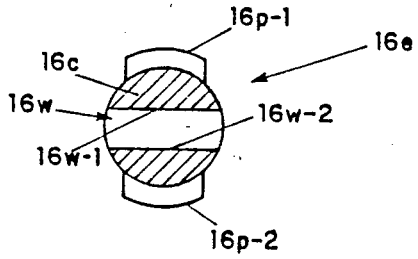
FIG. 2B is a cross sectional view of the tip of FIG. 2A.
Figure 2C:
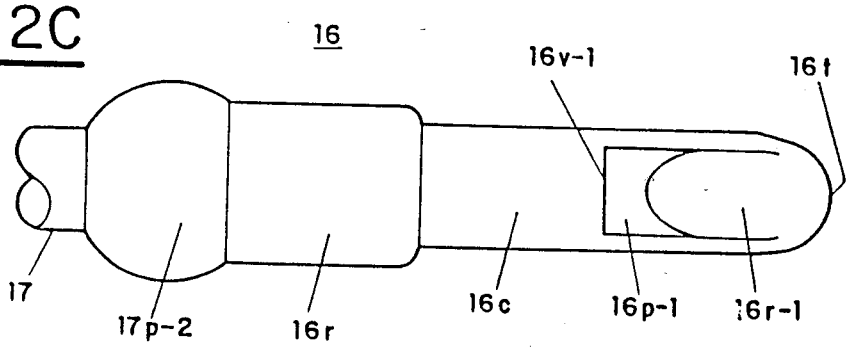
FIG. 2C is a top view of the tip portion of FIG. 2A.

The tip 16 of FIG. 2A includes an end 16*e* in the form of an aperture cylinder 16*c*. The aperture is a double wedge opening 16*w* with a first opening having diverging upper and lower surfaces 16*w*-1 and 16*w*-2 that diverge from a radius of curvature 16*c*-1. The balance of the opening 16*w* is formed by oppositely diverging wedge surfaces 16*w*-3 and 16*w*-4 that diverge from an end radius of curvature 16*c*-2. The extremeties of the wedge meet at the midsection of the cylindrical tip. Straddling the first portion of the wedge are oppositely positioned ramps 16*r*-1 and 16*r*-2. As indicated in FIGS. 2B and 2C the ramps 16*r*-1 and 16*r*-2 have planar outer surfaces and converge at the extreme tip 16*t* of the free member. They diverge outwardly to surfaces 16*p*-1 and 16*p*-2 with a curvature conforming to the underlying tip 16*c*.

Figure 3A:
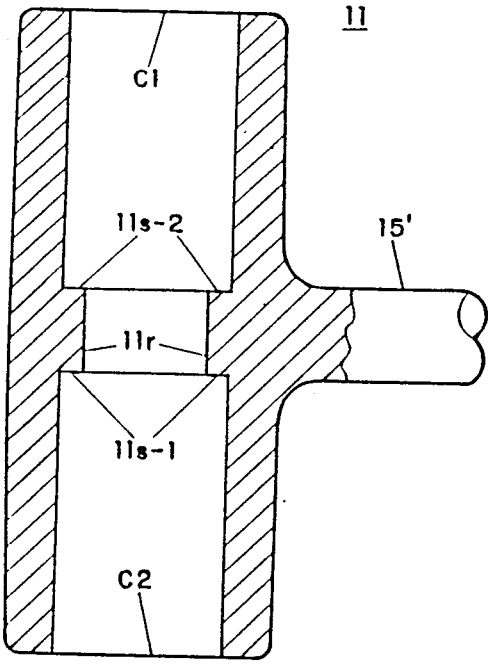
FIG. 3A is a cross-sectional view of the housing of the fastener shown in FIGS. 1A and 1B.
Figure 3B:
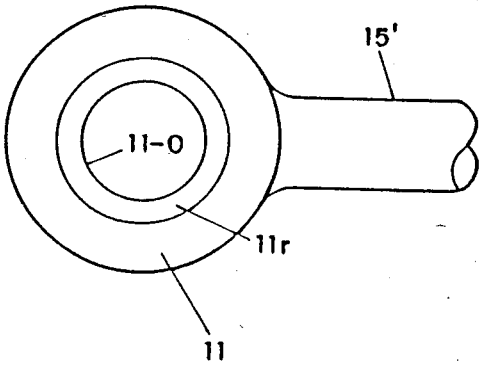
FIG. 3B is an end view of the housing of FIG. 3A.

The locking head 11 which receives the tip 16 is shown in section in FIG. 3A. Upon insertion of the tip 16 into either open end $C_1$ or $C_2$ of the head 11 the ramps 16*r*-1 and 16*r*-2 engage the inner surface of an internal ring 11*r*. Further movement of the tip into the housing 11 compresses the ramps into the double wedge opening 16*n*. Complete movement of the tip into the housing results in clearance of the ring 11*r* by the trailing vertical extremeties 16*r*-1 and 16*r*-2 of the ramps which thereupon spring back into their equilibrium position, locking the tip 16 against the opposite sides 11*s*-1 or 11*s*-2 of the locking ring 11*r*.

It is to be noted further that in addition to the protuberance 17*p*-1 there is a further protuberance 17*p*-2 at the end of the connector 17. This latter protuberance is designed to facilitate the insertion of the tip 16 into the locking head 11 by providing a convenient gripping point for the user. To that end the gripping protuberance 17*p*-2 is in the form of a partial sphere which is joined to a cylindrical embossment 16*r*. The further protuberance 17*p*-1 which is at the terminus of the reduced diameter neck 17*n* provides a convenient rupture point in the event of unauthorized tampering with the device, resulting in a fracture of the neck 17*n* at the protuberance 17*p*-1. Such tempering could result, for example if a purchaser attempted to remove the locked fastener from an item of merchandise by pulling on the extended filament 15' because the tip 16 becomes locked in the housing 11 upon insertion to the point that the end of the cylindrical embossment 16*r* contacts one of the sides 11*s*-1 or 11*s*-2 of the locking ring 11*r*. When the embossment is thus positioned, the vertical ends 16*v*-1 and 16*v*-2 of the ramps 16*r*-1 and 16*r*-2 engage the other side surface 11*s*-2 or 11*s*-1 of the locking ring ll*r*. Consequently, in this situation, if an attempt is made to pull the tip 16 from the housing 11, any failure of the fastener will take place at the reduced diameter neck 17*n* and the apertured tip that has become separated from the filament 15' remains in blocking position in the housing 11. This prevents any attempted reuse of the fastener and constitutes a security measure against unauthorized tampering and pilferage.

While various aspects of the invention have been set forth by the drawings and specification, it is to be understood that the foregoing detailed description is for illustration only and that various changes, as well as the substitution of equivalent constituents shown and described may be made without departing from the spirit and scope of the invention as set forth in the appended claims.

I claim:

1. A fastener comprising an elongated member having a free end with an aperture therein, said aperture extending along the axis of elongation of said member and being surrounded by a wall of said free end which has a single minimum thickness position intermediate the opposite ends of said aperture;

an elongated housing connected to the other end of said elongated member and receiving the free end therein; and means in said housing for receiving and compressing said end at the minimum wall thickness position of said aperture in order to lock said elongated member to said housing;

whereby the inclusion of said minimum wall thickness facilitates the compression of said free end and its entry into engagement with the locking means in said housing.

2. A fastener as defined in claim 1 wherein said housing is open at opposed ends thereof to permit the bidirectional entry of said elongated member therein.

3. A fastener as defined in claim 1 wherein the locking means comprises a circumferential ring in said housing.

4. A fastener as defined in claim 3 wherein said ring forms a plurality of discrete segments.

5. A fastener as defined in claim 1 wherein said free end is circular in external configuration and a planar ramp extends from the tip of said free end to an arc segment superimposed on said free end for locking said free end in said housing.

6. A fastener as defined in claim 5 wherein said tip includes ramps on opposite sides thereof.

7. A fastener as defined in claim 1 wherein said minimum thickness is at the position of said arc on said free end.

8. A fastener as defined in claim 7 wherein said elongated slot is symmetrically disposed with respect to said arc.

9. A fastener as defined in claim 1 wherein said elongated slot has an interior profile defined by back-to-back wedges.

10. A fastener as defined in claim 1 wherein said slot has its maximum width at midlength.

11. A fastener as defined in claim 9 wherein said wedge portions meet at a midposition.

12. A fastener as defined in claim 1 further including a partial sphere centered upon said elongated member before the tip portion thereof.

13. A fastener as defined in claim 12 wherein said partial sphere is joined to a cylindrical embossment before the tip portion of said elongated member.

14. A fastener as defined in claim 1 further including means associated with said elongated member for causing said free end to remain locked in said housing when said elongated member is thereafter separated from said free end in its locked position.

15. A fastener as defined in claim 14 wherein the causing means comprises a reduced diameter portion of said elongated member.

* * * * *